US008313581B2

(12) United States Patent
Bear et al.

(10) Patent No.: US 8,313,581 B2
(45) Date of Patent: Nov. 20, 2012

(54) INDUSTRIAL CLEANING SYSTEM AND METHODS RELATED THERETO

(75) Inventors: Philip Bear, Burnsville, MN (US); Kelly Brannick, Oak Grove, MN (US)

(73) Assignee: Philip Bear, Burnsville, MN (US)

( * ) Notice: Subject to any disclaimer, the term of this patent is extended or adjusted under 35 U.S.C. 154(b) by 745 days.

(21) Appl. No.: 12/188,895

(22) Filed: Aug. 8, 2008

(65) Prior Publication Data

US 2010/0031973 A1 Feb. 11, 2010

(51) Int. Cl.
*B08B 9/00* (2006.01)

(52) U.S. Cl. ..... 134/22.1; 134/24; 134/31; 15/1

(58) Field of Classification Search ..... None
See application file for complete search history.

(56) References Cited

U.S. PATENT DOCUMENTS

| | | | | |
|---|---|---|---|---|
| 4,977,910 | A | 12/1990 | Miyahara et al. | |
| 5,184,427 | A | 2/1993 | Armstrong | |
| 5,365,699 | A | 11/1994 | Armstrong et al. | |
| 5,778,831 | A * | 7/1998 | Jameel | 122/392 |
| 5,785,581 | A | 7/1998 | Settles | |
| 6,315,639 | B1 | 11/2001 | Kipp | |
| 6,447,377 | B1 | 9/2002 | Londenberg et al. | |
| 6,468,360 | B1 | 10/2002 | Andrews | |
| 6,558,473 | B2 | 5/2003 | Okazawa et al. | |
| 6,695,685 | B2 | 2/2004 | Stratford et al. | |
| 6,966,819 | B2 | 11/2005 | Carroll | |
| 7,033,249 | B2 | 4/2006 | Spalteholz et al. | |
| 2002/0046561 | A1 * | 4/2002 | Bronicki et al. | 60/39.182 |
| 2002/0068510 | A1 | 6/2002 | Okazawa et al. | |
| 2002/0068511 | A1 | 6/2002 | Okazawa et al. | |
| 2002/0086616 | A1 | 7/2002 | Tomlinson | |
| 2002/0139395 | A1 | 10/2002 | Andrews | |
| 2003/0073392 | A1 | 4/2003 | Stratford et al. | |
| 2005/0003741 | A1 | 1/2005 | Carroll | |
| 2005/0255013 | A1 * | 11/2005 | Teall et al. | 422/189 |
| 2005/0266777 | A1 | 12/2005 | Yoon | |
| 2005/0272347 | A1 | 12/2005 | Spalteholz et al. | |
| 2007/0178811 | A1 | 8/2007 | Sundaram et al. | |

FOREIGN PATENT DOCUMENTS

| | | | |
|---|---|---|---|
| DE | 10111237 | A1 * | 9/2002 |
| JP | 62064952 | A * | 3/1987 |

* cited by examiner

*Primary Examiner* — Eric Golightly
(74) *Attorney, Agent, or Firm* — Schwegman Lundberg Woessner P.A.

(57) ABSTRACT

A method of cleaning industrial equipment includes propelling a sublimable media through a discharge wand. An inner surface and an outer surface of an object are contacted with the media. The media subsequently dissipates or is consumed.

14 Claims, 1 Drawing Sheet

INDUSTRIAL CLEANING SYSTEM AND METHODS RELATED THERETO

BACKGROUND

Many industrial and commercial equipment and facilities accumulate residue or debris that is difficult to remove. High pressure water blasting is often undesirable, as removing the spent water can be difficult in enclosed spaces and water can damage expensive industrial equipment. Sublimable particles (such as dry ice) applied at high velocity and pressure may be used in cleaning processes. Such particles are efficient in removing residue, but also sublime upon contact leaving no leftover cleaning material.

Some industrial equipment is manufactured and configured in such a way that cleaning an outside surface by blasting is very inefficient. Many types of boilers, furnaces and dryers have internal coils or tubes that are stacked many feet deep with little spacing in between. The surface of the bundles of tubes or coils may be cleaned, but reaching all sides of the interior of such bundles with existing equipment and processes is problematic.

BRIEF DESCRIPTION OF THE DRAWINGS

In the drawings, which are not necessarily drawn to scale, like numerals describe substantially similar components throughout the several views. Like numerals having different letter suffixes represent different instances of substantially similar components. The drawings illustrate generally, by way of example, but not by way of limitation, various embodiments discussed in the present document.

SUMMARY

Figure 1:
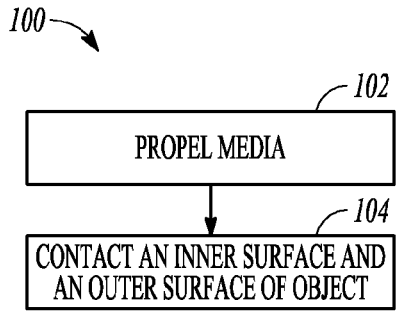
FIG. 1 illustrates a block flow diagram of a method of cleaning, according to some embodiments.

Embodiments of the present invention relate to a method of cleaning, including propelling a media through a discharge wand and contacting an inner surface and an outer surface of an object with the media. The media subsequently dissipates or is consumed.

Embodiments also relate to a cleaning system, including a media source for storing and providing a media, a discharge wand, a propellant for moving the media from the source to the discharge wand and a nozzle positioned on the distal end of the wand In addition, embodiments also relate to a nozzle for directing propelled cleaning media, including a body, an angled end positioned on the distal end of the body and a discharging orifice. The angle of the angled end is great enough to deflect propelled media to an inner surface of an object without breaking or dissipating the particles.

DETAILED DESCRIPTION

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense, and the scope of the present invention is defined by the appended claims and their equivalents.

In this document, the terms "a" or "an" are used to include one or more than one and the term "or" is used to refer to a nonexclusive "or" unless otherwise indicated. In addition, it is to be understood that the phraseology or terminology employed herein, and not otherwise defined, is for the purpose of description only and not of limitation. Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference should be considered supplementary to that of this document; for irreconcilable inconsistencies, the usage in this document controls.

Embodiments of the invention relate to a system and method for cleaning of industrial equipment with dry ice or similar media. Embodiments also relate to a nozzle for directing the flow of the cleaning media to the area to be cleaned. Using a sublimable media to clean allows for the media to dissipate and not interfere with the equipment or surface being cleaned. Alternatively, if cleaning a furnace or boiler, media that can be burned or consumed may be used. The high pressure and velocity at which the media contacts residue or debris loosens and removes such particles. Further, the adiabatic expansion of sublimable material upon contact also assists in breaking the debris free from the surface.

In many industrial plants or factories, such as biofuel production facilities, the equipment is run 24 hours a day and only stopped a few times a year for maintenance. During such down-times, the equipment may be repaired, replaced or cleaned, for example. This down-time is relatively short, often a matter of hours or a few days, and accessing and cleaning large equipment is difficult. Many areas or portions of equipment are found in confined spaces with minimal breathable air. Operators utilizing the embodiments of the present invention may need to be trained or certified in confined space operation. The methods, system and apparatus of the present invention provide for cleaning of inner and outer surfaces of equipment (in relation to the position of the operator). Current cleaning methods for heavy equipment only are capable of cleaning an outer surface or surface facing an operator. Methods and equipment described in the following description provide for ways to clean hard-to-reach equipment and plant facilities, in a fast, efficient manner. The methods of the present invention are especially in demand for cleaning boiler and furnace coils in ethanol plants, during plant downtime, for example.

Referring to FIG. 1, a block flow diagram 100 of a method of cleaning is shown, according to some embodiments. Media may be propelled 102 through a discharge wand and contact 104 an inner and outer surface of an object with the media. The media may subsequently dissipate or be consumed.

The media may be carbon dioxide (dry ice) pellets, for example. The pellets may be small, such as rice-grain sized. Another example of a dissipating media would be liquid nitrogen. The media may also be consumable and not sublimable or dissipating, such as corn cob particles, walnut shells or baking soda. Sublimable particles have the advantage of dissipating without leaving a spent media (subliming from solid to gas). In addition to the high velocity application of particles to remove debris, sublimable particles adiabatically expand upon contact with the residue or debris which assists in the removal of such unwanted species. If consumable, they may be burned or reacted in or near the surface of the equipment in which they contact. One example would be after cleaning a portion of a furnace or boiler, the spent media would then be burn upon use of the furnace.

A media source may store the media and could also operate in the transport of the media to a discharge wand. The media store may be a permanent or portable storage tank. The media source may also be a reactor or an in-line process that produces the media for cleaning, rather than only storing the media. In a biofuel production plant, carbon dioxide often produced as a by-product. Such carbon dioxide can be used as the media and the source may be the in-line process that produces the carbon dioxide or subsequently converts it to a suitable size or form for cleaning.

The media may be propelled 102 from a media source to the discharge wand by a transport gas, a pressure differential, a compressor, a pump. The media may be discharged at a high pressure and velocity, such as to effectively contact 104 and remove the residue or debris from the object to be cleaned. The transport gas may be air, for example. The media may be propelled 102 at variable speeds and rates. The media may be propelled 102 at about 1 lbs/min, about 1.5 lbs/min, about 2 lbs/min, about 2.5 lbs/min, or about 3 lbs/min, for example. Depending on the application and type of residue for removal, the amount and rate of media discharging is varied, which affects its velocity.

The object to be cleaned may be surfaces of industrial equipment or structures. The method of the present invention may be used to clean an outer surface and an inner surface, in relation to the position of the operator. Examples of commercial or industrial facilities include biofuel production plants, such as ethanol and biodiesel plants. The equipment to be cleaned may include furnaces, combustion systems, boilers, heat exchangers, dryers and underground tunnels. More specifically, reverse thermal oxidizers (RTO) and thermal oxidizers may be cleaned. Many of these pieces of equipment contain bundles or stacks of inner coils or tubes. During the commercial process, these coils become covered and caked with residue, such as ash, dried distillers grains, refractory material, corn syrup residue, dirt and dust. Such coils may be stacked horizontally, vertically, in both directions and may be continuous coils with many loops. The stacks or bundles may be rectangular or circular and may be several feet to dozens of feet deep. The tubes or coils may be smooth or may have numerous fins, depending on the type.

Figure 2:
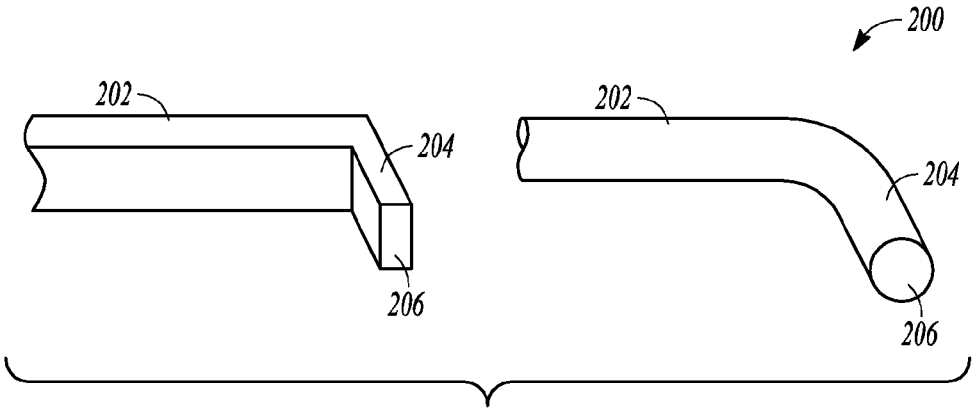
FIG. 2 illustrates a perspective view of discharge nozzles, according to some embodiments.
Figure 3:
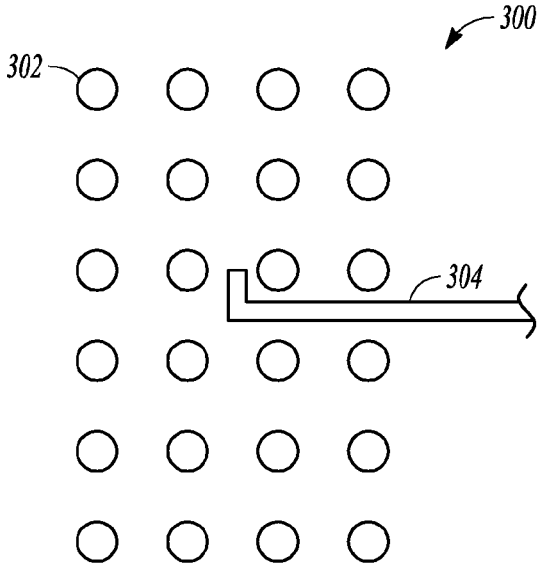
FIG. 3 illustrates a cross-section view of discharge wand and nozzle positioned within a bundle of tubes, according to some embodiments.

In order to clean the inner surfaces of an object, the discharge wand may be configured with a nozzle for directing the media to an inner surface. The nozzle (see view 200 of FIG. 2) may include a body 202, an angled end 204 positioned distally on the body 202 and a discharging orifice 206. The angled end 204 allows for the propelled media to contact an inner surface, while the operator generally faces an outer surface. The body 202 may be attached to the discharging wand or be a uniform piece with the wand. The body 204, or the body 204 in combination 304 with a wand, may be from about 3 feet to about 8 feet in length (see view 300 of FIG. 3). One of the limiting factors in the length of the body 204, or body 204 and wand together, is the weight and the ability of the operator to hold the unit comfortably. The longer the body or wand, the farther into a stack or bundle of tubes 302 the cleaning may occur. The angled end 204 may be about 45 degrees to about 85 degrees. The angle must be great enough for the media to deflect and reach the inner surface or backside of an object, but not so sharp as to break or dissipate the media the juncture between the end 204 and body 202. The body 202 or end 204 may be rectangular or circular, for example. The discharging orifice 206 may similarly be rectangular or circular and have an opening of about 0.15 inches to about 0.5 inches by about 1 inch to about 4 inches, for example. If circular, the diameter may be about 0.5 inches to about 4 inches. The nozzle may be manufactured of any durable, lightweight material. Examples of such materials include aluminum or plastic.

In order to clean hard-to-reach components of industrial equipment, operators may be required or advised to be trained in confined space operations. The operator may then enter the equipment to be cleaned, such as a boiler, at an access point using protective clothing (e.g., Tyvek® suit) and a supply of fresh air. A second person may be positioned outside the access point for safety, such as to monitor the air supply and movements of the operator. The second person may also be in audio and visual communication with the operator. Sensors may be positioned in the work space or near the access point to monitor air quality and explosive gas levels. The operator may then use the above mentioned methods of cleaning the outer surfaces of one or more stacks or bundles of tubes or coils. The inner surfaces may be reached by utilizing the angled nozzle and cleaning the backside of the tubes, including any fins or protrusions on the tubes. A second access point may be utilized for exhaust, such as by positioning an exhaust fan or vacuum away from the operator to draw loosened debris and spent media.

Underground tunnels in industrial facilities may be cleaned utilizing the methods and system of the present invention. Using a dissipating media is advantageous underground, as water or other media may be difficult to dispose of. Exhaust fans or vacuums may be utilized a point opposite the area of cleaning. Therefore, the operator may clean toward the exhaust and the spent media and debris may be removed from the area. The exhaust fans or vacuums may be portable and be re-positioned as cleaning continues.

What is claimed is:

1. A method of cleaning, comprising:

propelling a sublimable media through a discharge wand;

inserting the wand between coils in a boiler;

an operator contacting an inner surface and an outer surface of the coils with the media via media discharged from a distal end of the discharge wand, wherein the media is deflected at the distal end of the wand such that the discharge media exits the wand with a zero angle of discharge from a discharging orifice of the wand but with a non-zero angle of discharge from the wand compared to the direction of travel of the media upstream of the distal end of the discharge wand that is inserted between the coils sufficient to facilitate contact with the inner surface, wherein the inner surface includes bundles of inner coils, and wherein the operator is facing the outer surface;

wherein a cross section of the discharge wand is substantially constant from upstream of the angle at the distal end to the discharge orifice; and wherein the media subsequently dissipates or is consumed.

2. The method of claim 1 wherein the media is discharged through a nozzle at the distal end of the discharge wand with an angle of discharge of about 45 to about 85 degrees such that media is not dissipated prior to contacting the coils.

3. The method of claim 1, wherein the media comprises carbon dioxide pellets or liquid nitrogen.

4. The method of claim 1, wherein the coils comprise biofuel production equipment.

5. The method of claim 1, wherein the wand inserted between the coils is straight and at least three feet long.

6. The method of claim 1, wherein propelling comprises transferring the media with a transfer gas.

7. The method of claim 6, wherein the transfer gas comprises air.

8. The method of claim 1, wherein contacting comprises the media physically contacting residue or debris in contact with the surfaces.

9. The method of claim 1, wherein contacting comprises the media sublimating upon contact with the surfaces or residue in contact with the surfaces.

10. A method of cleaning, comprising:

propelling a sublimable media through a discharge wand;

inserting the wand between coils in a biofuel production boiler from a front surface of the coils;

contacting outer and inner surfaces of the coils with the media discharged from a discharge end of the wand with an non-zero angle of discharge from the wand compared to the direction of travel of the media within the portion of the wand prior to a discharge end wherein the wand is inserted between the coils sufficient to facilitate contact with the inner surface, wherein the inner surface includes bundles of inner coils;

wherein a cross section of the discharge wand is substantially constant from upstream of the angle at a distal end to the discharge orifice and immediately upon discharge from the discharge orifice the media is completely outside of the wand; and wherein the media subsequently dissipates or is consumed.

11. The method of claim 10 wherein sublimable media comprises carbon dioxide pellets.

12. The method of claim 10, wherein contacting comprises the media physically contacting residue or debris in contact with the surfaces.

13. A method of cleaning, comprising:

propelling carbon dioxide pellets through a discharge wand;

inserting the wand between coils in a boiler;

an operator contacting an inner surface and an outer surface of the coils with the carbon dioxide pellets via carbon dioxide pellets discharged from a distal end of the discharge wand, wherein the carbon dioxide pellets are deflected at the distal end of the wand such that the carbon dioxide pellets exit the wand with a zero angle of discharge from a discharge orifice, but a non-zero angle of discharge from the wand compared to the direction of travel of the media upstream of the distal end of the discharge wand that is inserted between the coils sufficient to facilitate contact with the inner surface, wherein the inner surface includes bundles of inner coils, and wherein the operator is facing the outer surface;

wherein substantially all of the carbon dioxide pellets maintain their integrity upon deflection and discharge; and wherein the carbon dioxide pellets subsequently dissipates.

14. The method of claim 13 wherein a cross section of the discharge wand is substantially constant from upstream of the angle at the distal end to the discharge orifice.

* * * * *